US005593150A

United States Patent [19]

Katayanagi et al.

[11] Patent Number: 5,593,150

[45] Date of Patent: Jan. 14, 1997

[54] SHEET FEEDING APPARATUS FOR A RECORDING APPARATUS

[75] Inventors: Jun Katayanagi, Musashino; Takeji Niikura, Kawasaki, both of Japan

[73] Assignee: Canon Kabushiki Kaisha, Tokyo, Japan

[21] Appl. No.: 13,190

[22] Filed: Jan. 29, 1993

Related U.S. Application Data

[63] Continuation of Ser. No. 771,534, Oct. 7, 1991, abandoned, which is a continuation of Ser. No. 658,433, Feb. 20, 1991, abandoned, which is a continuation of Ser. No. 223,109, Jul. 22, 1988, abandoned.

[30] Foreign Application Priority Data

| | | | |
|---|---|---|---|
| Aug. 18, 1987 | [JP] | Japan | 62-204344 |
| Aug. 18, 1987 | [JP] | Japan | 62-204345 |
| Aug. 21, 1987 | [JP] | Japan | 62-207554 |
| Aug. 21, 1987 | [JP] | Japan | 62-207555 |
| Aug. 21, 1987 | [JP] | Japan | 62-207559 |

[51] Int. Cl.[6] ..... B65H 3/52

[52] U.S. Cl. ..... 271/121

[58] Field of Search ..... 271/21, 22, 121–127, 271/161, 171, 239, 240, 9, 16, 167, 169, 170

[56] References Cited

U.S. PATENT DOCUMENTS

| | | | |
|---|---|---|---|
| 576,116 | 2/1897 | Hansen | 271/121 |
| 1,077,408 | 11/1913 | Lelfield | 271/149 X |
| 1,153,339 | 9/1915 | Rogers | 271/121 |
| 3,285,601 | 11/1966 | Zeuthen | 271/22 |
| 3,447,799 | 6/1969 | Bishop | 271/21 |
| 4,030,723 | 6/1977 | Irvine | 271/121 X |
| 4,145,041 | 3/1979 | Kew | 271/314 X |
| 4,240,622 | 12/1980 | Rutishauser | 271/161 X |
| 4,245,831 | 1/1981 | Michatek | 271/171 |
| 4,303,235 | 12/1981 | Calabrese | 271/9 X |
| 4,394,010 | 7/1983 | Hogenson | 271/22 |
| 4,395,034 | 7/1983 | Fukui | 271/21 |
| 4,424,964 | 1/1984 | Kikuchi | 271/9 |
| 4,457,507 | 7/1984 | Ishikawa | 271/171 X |
| 4,588,182 | 5/1986 | Nakanishi | 271/121 |
| 4,623,138 | 11/1986 | Sakamaki et al. | 271/169 X |
| 4,627,607 | 12/1986 | Ishi | 271/9 X |
| 4,699,366 | 10/1987 | Kashimura et al. | 271/4 |
| 4,778,168 | 10/1988 | Kashimura et al. | 271/4 |
| 4,813,612 | 3/1989 | Kano | 271/121 X |

FOREIGN PATENT DOCUMENTS

| | | | |
|---|---|---|---|
| 0251819 | 1/1988 | European Pat. Off. | 271/167 |
| 133151 | 7/1984 | Japan | 271/240 |
| 0016952 | 1/1987 | Japan | 271/167 |

*Primary Examiner*—William E. Terrell
*Assistant Examiner*—T. Kelly
*Attorney, Agent, or Firm*—Fitzpatrick, Cella, Harper & Scinto

[57] ABSTRACT

A sheet feeding apparatus for a recording apparatus in which recording sheets set on a sheet insertion section are fed to a recording section and recording is effected, has, in the sheet insertion section, a sheet feeding roller formed into a cylindrical shape and having a circumferentially extending groove portion formed in the lengthwisely intermediate portion thereof, a guide having a guide surface for guiding the recording sheets to the sheet feeding roller, and a projected member formed projectedly from the guide surface of the guide toward the groove portion of the sheet feeding roller for separating and feeding the recording sheets one by one by the sheet feeding roller.

20 Claims, 9 Drawing Sheets

SHEET FEEDING APPARATUS FOR A RECORDING APPARATUS

This application is a continuation of application Ser. No. 07/771,534 filed Oct. 7, 1991, abandoned, which is a continuation of application Ser. No. 07/658,433 filed Feb. 20, 1991, abandoned, which is a continuation of application Ser. No. 07/223,109 filed Jul. 22, 1988, abandoned.

BACKGROUND OF THE INVENTION

1. Field of the Invention

This invention relates to a sheet feeding apparatus for a recording apparatus which is capable of separating a plurality of cut sheets one by one and conveying them to a recording section.

2. Related Background Art

Generally, some recording apparatuses such as printers have an automatic sheet feeding apparatus in which a recording sheet is set in a sheet insertion port and after a predetermined switch is closed, the sheet is automatically fed to a recording start position.

An example of such apparatus is shown in FIG. 6 of the accompanying drawings. In FIG. 6, the reference numeral 1 designates a carriage on which a ribbon cassette 2 and a thermal head 3 as a recording head are carried. The carriage 1 is guided by a guide shaft 4 and a guide rail 5 and is reciprocally moved in a direction perpendicular to the plane of the sheet. A planar platen 6 formed lengthwisely in a direction perpendicular to the plane of the sheet and having a flat portion 6A which bears against the thermal head 3 is fixed to the opposed surface of the thermal head 3.

The reference numeral 7 denotes a sheet feeding roller rotatably supported on a shaft 8 and rotatively driven by a motor or the like, not shown. A pair of pinch rollers 9-1 and 9-2 are resiliently urged against the lower surface of the sheet feeding roller 7. The reference numeral 10 designates a sheet feeding guide formed integrally with the housing 11 of the printer. The sheet feeding guide 10 slowly comes close to the sheet feeding roller 7 from the left as viewed in FIG. 6, and rotatably supports the pinch rollers 9-1 and 9-2 at the lower end thereof.

In the above-described recording apparatus, when a recording sheet 12 is to be set at the recording start position, the sheet 12 is set onto the sheet feeding guide 10 through a sheet insertion port 13 and the leading end edge thereof is pushed into the nip point 14 between the sheet feeding roller 7 and the pinch roller 9-1. By depressing a switch or the like, not shown, the sheet feeding roller 7 is rotated by a predetermined amount and the leading end edge of the recording sheet is inserted between the thermal head 3 and the platen 6. Thereafter, the thermal head 3 is lowered, and then recording is effected.

In the above-described recording apparatus, recording sheets can be manually set one by one. However, separation and feeding in which a plurality of recording sheets are separated one by one and continuously fed cannot be accomplished, and to accomplish such separation and feeding, it has been necessary to separately provide an exclusive sheet feeding apparatus such as a cut sheet feeder.

There is a recording apparatus unitarily incorporating a cut sheet feeder therein. However, such recording apparatus has suffered from disadvantages of bulkiness and complicated structure.

Also, FIG. 7 of the accompanying drawings is a schematic view showing a force acting on cut sheets in a conventional sheet feeding apparatus.

In FIG. 7, piled cut sheets 71 are urged against a sheet feeding roller 72 with pressure force P1 through a spring-biased pressure plate or the like, and the leading end edges of the cut sheets 71 are held down by a separating projection 73 projectedly provided on the axially divided portion of the sheet feeding roller 72, as shown.

The sheet feeding possibility condition and the dual feed preventing condition when in this state, the sheet feeding roller 72 is rotatively driven in the direction of arrow B can be represented by the following equations (1) and (2):

$$F6=\mu 1 \cdot P1-\mu 2 \cdot P1>R \quad (1)$$

$$F7=\mu 2 \cdot P1-\mu 3 \quad p1<R \quad (2)$$

where respective symbols represent the following amounts:

F6: conveying force for the first sheet

F7: conveying force for the second sheet

P1: sheet pressing force

R: riding-over force of the separating projection 73

μ1: coefficient of friction between the sheet feeding roller 72 and the first sheet μ2: coefficient of friction between the first sheet and the second sheet μ3: coefficient of friction between the second sheet and the third sheet Generally, μ2 and μ3 are the same, but in some cases, they differ from each other due to the irregularity of the sheets and the state of contact thereof.

Now, the sheets (including various recording media such as postcards, cards and plain paper) have their rigidity greatly varied by the environment (temperature, humidity or the like) and further have their surface condition and coefficient of friction also varied by the environment.

Also in the sheet feeding roller 72, the coefficient of friction is varied by the environment.

At a low temperature and low humidity (for example, of the order of 5° C. and 10%, respectively), the rigidity of the sheets (such as postcards) becomes higher and the riding-over force R increases and the coefficients of friction μ2 and μ3 between the sheet (such as the postcard) and the sheet (such as the postcard) and the coefficient of friction μ1 between the sheet and the sheet feeding roller decrease.

On the other hand, at a high temperature and high humidity (for example, of the order of 35° C. and 90%, respectively), the rigidity of the sheets (such as postcards) becomes lower and the riding-over force R decreases and the coefficients of friction μ2 and μ3 between the sheet and the sheet and the coefficient of friction μ1 between the sheet and the sheet feeding roller increase.

From what has been described above, at a low temperature and low humidity, μ1 and μ2 are small and R is great in equation (1) and therefore, the sheet (such as the postcard) does not ride over the separating projection 73, but slip becomes liable to occur between the sheet feeding roller 72 and the sheet 71.

On the other hand, at a high temperature and high humidity, μ2 and μ3 are great and R is small in equation (2) and therefore, a phenomenon that two sheets (such as two postcards) are fed at a time (dual feeding) is liable to occur.

To solve the above-noted problems, it is known to vary the pressure contact force P1 of the sheet 71 with the sheet feeding roller 72 and the amount of overlap H between the separating projection 73 and the sheet feeding roller 72 which determines the riding-over force R of the separating projection 73, to thereby find a shape and dimensions which satisfy the conditions of the aforementioned equations (1) and (2) in all environments.

However, equation (1) which is the sheet feeding possibility condition and equation (2) which is the dual feed preventing condition are conditions contrary to each other as previously described and therefore, it is very difficult to satisfy the both conditions in all environments, and it has been impossible to obtain a stable sheet feeding performance in all environments by the sheet feeding apparatus using the conventional separating projection.

There is also a recording apparatus provided with a sheet feeding apparatus of the type which automatically feeds cut sheets one by one by a feed roller serving also as a separating roller.

In the recording apparatus of such type, there are generally provided a sheet sensor for detecting the leading end edge of a sheet and thereby determining the recording start position, and a discharge roller for continuously discharging sheets on which recording has been effected.

The sheet sensor is for automatically accomplishing the heading (to the recording position) of a sheet, and is generally designed to detect the passage of the leading end edge of the sheet, and then feed the sheet by a prescribed amount, thereby accomplishing the heading of the sheet.

Also, the discharge roller has the same amount of sheet conveyance as that of the feed roller, and is generally driven simultaneously with the feed roller and also takes partial charge of the sheet feeding function.

Now, in the recording apparatus of the above-described type, the separating roller and the feed roller are the same roller and thus, the first and second sheet are continuously conveyed.

This has led to the problem that no gap is present between the two sheets and the leading end edge of the second sheet cannot be sensed by the sheet sensor and the heading cannot be accomplished.

SUMMARY OF THE INVENTION

It is an object of the present invention to make a sheet feeding apparatus in a recording apparatus in which a plurality of cut sheets can be separated one by one and conveyed to a recording section inexpensive, compact and simple and yet capable of operating well.

It is another object of the present invention to enable automatic sheet separation and feeding to be accomplished by merely adding simple changes to an ordinary recording apparatus.

It is still another object of the present invention to automatically separate and feed sheets without oblique movement or skew of the sheets.

It is yet still another object of the present invention to accomplish separation and feeding of sheets stable for any change in the environment.

It is a further object of the present invention to ensure heading of sheets to be accomplished reliably.

Other objects of the present invention will become apparent from the following detailed description when read in conjunction with the accompanying drawings.

DESCRIPTION OF THE PREFERRED EMBODIMENTS

Figure 1:
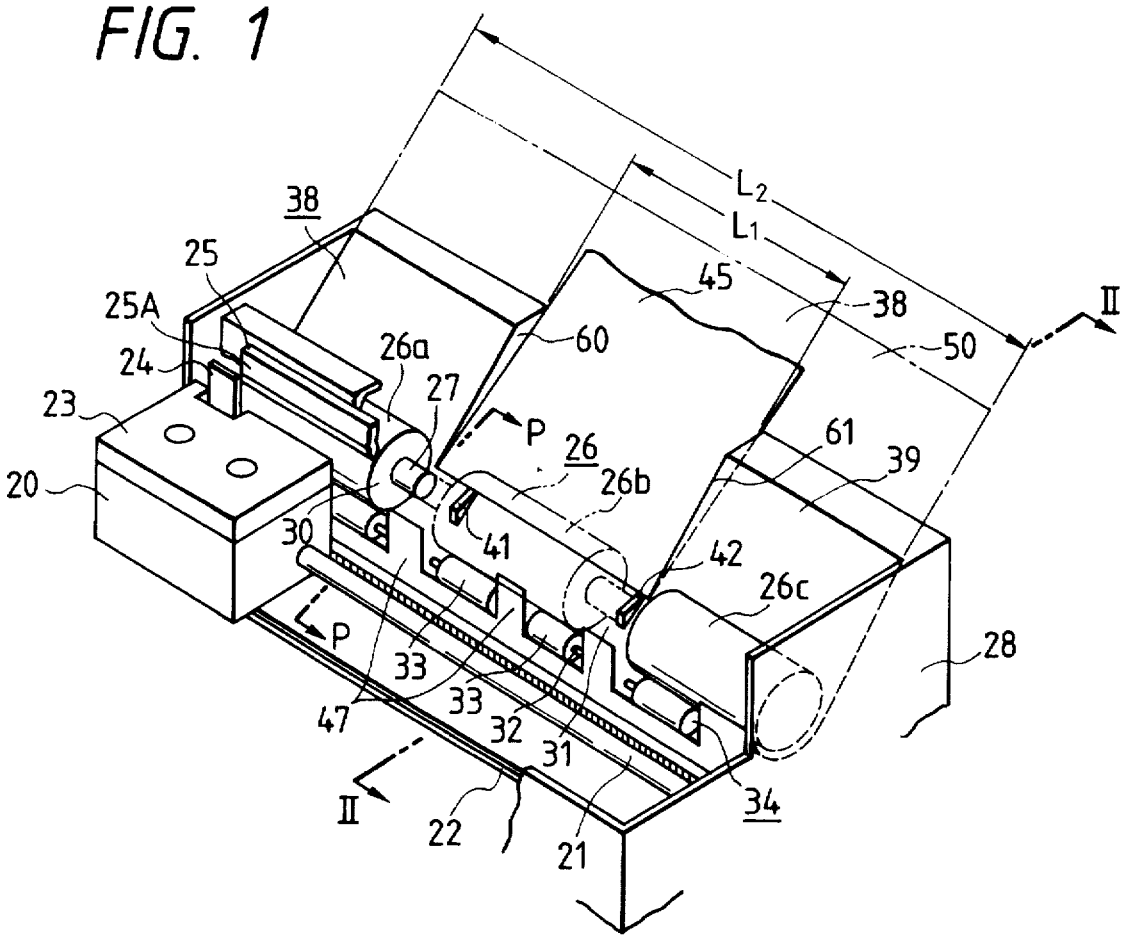
FIGS. 1 to 3 show a first embodiment of the present invention, FIG. 1 being a perspective view of the first embodiment, FIG. 2 being a cross-sectional view taken along line II—II of FIG. 1, and FIG. 3 being a cross-sectional view taken along line III—III of FIG. 2.

FIG. 1 shows a thermal printer having a sheet feeding apparatus according to a first embodiment of the present invention. In FIG. 1, the reference numeral 20 designates a carriage which is reciprocally moved along a guide shaft 21 and a guide rail 22 by a motor or the like, not shown. A thermal head 24 and an ink ribbon cassette 23 are carried on the carriage 20 and are moved along a planar platen 25. The platen 25 extends lengthwisely over the full range of movement of the carriage 20 and bears against the thermal head 24 on a planar surface 25A.

The reference numeral 26 denotes a cylindrical sheet feeding roller rotatably held on a printer chassis 28 by a shaft 27. The sheet feeding roller 26 is rotatively driven by a motor, not shown. The sheet feeding roller 26 has groove portions 30 and 31 extending circumferentially thereof in the axially intermediate portion thereof. Accordingly, the sheet feeding roller 26 is of a construction provided with three independent roller portions 26*a*, 26*b* and 26*c*. Each of the roller portions 26*a*–26*c* is formed of a rubber material having a high coefficient of friction, such as, for example, chloroprene rubber.

A pinch roller train 34 comprising a plurality of pinch rollers 33 rotatably supported coaxially with a shaft 32 and a pinch roller train 37 comprising a plurality of pinch rollers 36 rotatably supported coaxially with a shaft 35 are resiliently held on the sheet feeding roller 26.

The reference numeral 38 designates a sheet guide formed integrally with the chassis 28. The sheet guide 38 is a so-called paper pan. The sheet guide 38 is formed of ABS resin or the like containing much rubber composition to provide a moderate frictional force, and where the sheet guide is not formed of such material, a urethane rubber sheet may be attached to the surface of the sheet guide. The sheet guide 38 has a guide surface 39 inclined at an angle of θ1 (FIG. 2) with respect to the horizontal plane from the rear toward the sheet feeding roller 26, as viewed in FIG. 1, a recess 38A formed in such a manner as to be depressed in the guide surface 39, and a guide surface 40 formed at the bottom of the recess 38A and inclined at an angle of θ2 (FIG. 2) with respect to the horizontal plane toward the sheet feeding roller 26, and the guide surface 39 and the guide surface 40 are connected together by connecting portions 60 and 61. As is clear from FIG. 2, θ1>θ2. The width of the guide surface 39 is L2, and here sheets of ordinary thickness are manually fed. On the other hand, the width of the guide surface 40 is L1 (which, in the present embodiment, corresponds to the length of an official postcard), and here thick sheets such as postcards are automatically separated and fed. Also, L1<L2.

Below the guide surface 40, separating projections 41 and 42 are formed so as to protrude toward the groove portion 30 between the roller portions 26*a* and 26*b* of the sheet feeding roller 26 and the groove portion 31 between the roller portions 26*b* and 26*c* of the sheet feeding roller 26, respectively.

Figure 2:
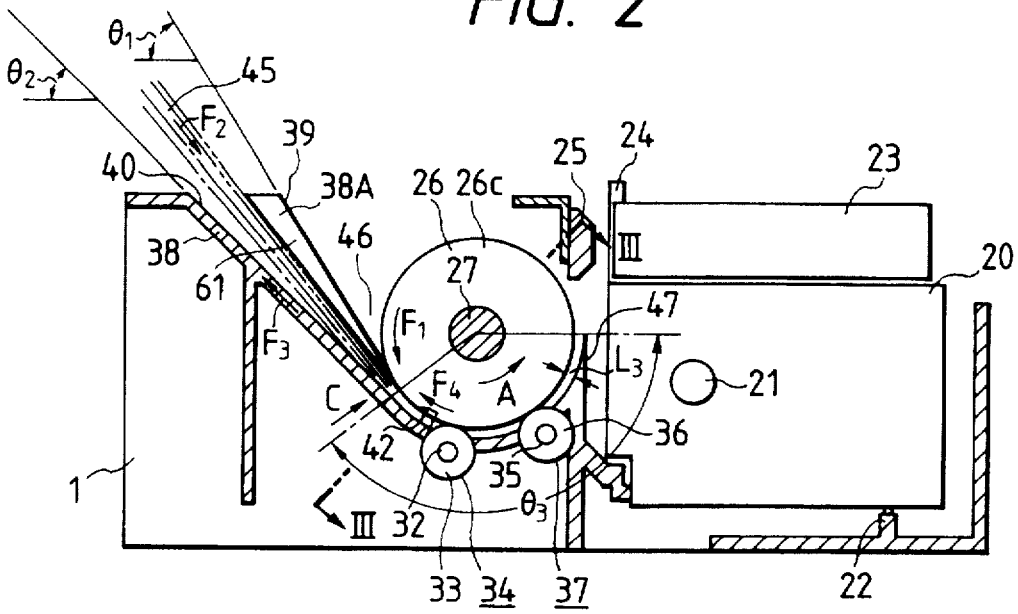

FIG. 2 shows a cross-section taken along line II—II of FIG. 1. The separating projection 42 (and the separating projection 41 also), as shown, has an inclined shape protruding toward the sheet feeding roller 26 as it shifts downwardly from the guide surface 40, and has a portion of its tip end overlapping the groove portion 30 (and the groove portion 31 also). With the aid of such a shape, when thick recording sheets, for example, official postcards 45, are placed onto the guide surface 40 through a sheet insertion port 46 and the sheet feeding roller 26 is rotated in the direction of arrow A, the postcards 45 are separated one by one and fed toward the platen 25 by the sheet feeding roller 26.

On the other hand, the fore end portion of the sheet guide 38, i.e., that portion thereof which is below the sheet feeding roller 26, is arcuately curved along the sheet feeding roller 26 and further, the tip end 46 thereof is also curved along the sheet feeding roller 26. Accordingly, in the area of the sheet guide 38 which is inclined at an angle of θ3, a gap L3 sufficient to permit the sheets to be fed is formed between the guide surface of the sheet guide 38 and the surface of the sheet feeding roller 26.

The position at which the separating projections 41 and 42 mesh with the sheet feeding roller 26 is inside of the angle θ3 as shown, and is upstream of the nip point between the pinch roller 33 and the sheet feeding roller 26 with respect to the direction of sheet feeding. This is because the separation of the postcards is effected by the cooperation between the separating projections 41, 42 and the sheet feeding roller 26, and the postcard 45, after separated, is fed by the sheet feeding roller 26 and the pinch rollers 33, 36.

Figure 3:
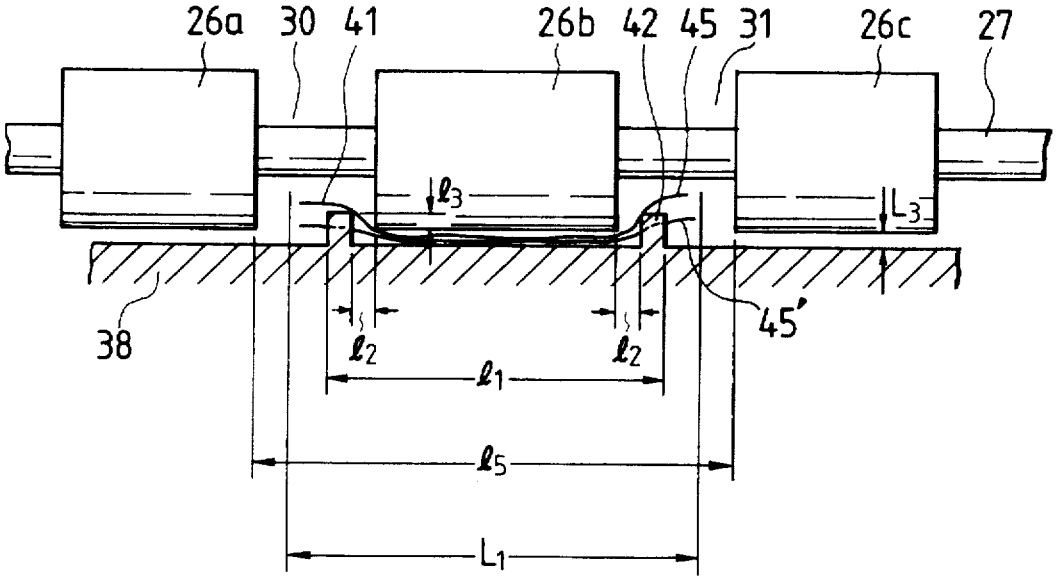

FIG. 3 shows the relations of the separating projections 41, 42 with the sheet feeding roller 26 and the postcard 45, and is a cross-sectional view taken along line III—III of FIG. 2.

As shown, the spacing between the separating projections 41 and 42 is l1, the distance between the end surface of the roller portion 26*a* and the end surface of the roller portion 26*c*, i.e., the maximum distance between the groove portions 30 and 31, is l5, the distance between the end surface of the roller portion 26*b* and the end surfaces of the separating projections 41, 42 is l2, and the overlap width between the sheet feeding roller 26 and the separating projections 41, 42 is l3.

Here, l2 and l3 are determined in conformity with the thickness of the recording sheet used, and in the case of an official postcard, the most suitable values in 0≦l2≦10 mm and 0≦l3≦5 mm are set.

Also, when the width of the recording sheet used is L, dimensions are set with L being l1≦L<l5.

Description will now be made of the situation when automatic separation and feeding is effected in the above-described first embodiment. In the present embodiment, postcards are used as thick recording sheets. In FIG. 2, the conveying force for the postcards 45 by the roller portion 26*b* of the sheet feeding roller 26 is F1, the mutual frictional force between the postcards 45 is F2, the frictional force of the guide surface 40 of the sheet guide relative to the lowermost postcard 45 is F3, and the resistance force with which the postcard 45 rides over the separating projections 41 and 42 is F4.

In the present embodiment, the surface conditions of the materials of the sheet feeding roller 26 and the sheet guide 38 are set so that the relation that F1>F3>F2 is established to accomplish separation and feeding.

In FIG. 2, when the sheet feeding roller 26 starts to rotate, the bundle of postcards 45 is pulled downward by the force F1 and tries to enter into the gap L3 between the guide surface 40 and the roller portion 26*b*. However, at this time, due to the frictional force F3, the postcard adjacent to the guide surface 40 tries to stay at that position. Thus, a first separating action acts on the bundle of postcards 45, and a number of (one to three) postcards determined by the force F1 and the gap L3 enters into the gap L3.

Subsequently, the postcards having entered into the gap L3 strike against the separating projections 41 and 42 and undergo a second separating action by the resistance force F4. Here, the condition that F1>F4>F2 is set. This is for separating only one postcard and passing it between the roller portion 26*b* and the separating project ions 41, 42. That is, several postcards conveyed by the roller portion 26*b* try to stop under the resistance force F4 of the separating projections 41, 42, but only the uppermost postcard subjected directly to the conveying force F1 by the roller portion 26*b* is intactly conveyed against the resistance force F4.

Further, when the uppermost postcard 45 rides onto the separating projections 41, 42 as shown in FIG. 3, the resistance force F4 is mitigated and the postcard 45 is urged against the roller portion 26*b* by the rigidity of the postcard itself, and the postcard 45 is intactly fed to a position at which it is nipped between the roller portion 26*b* and the pinch roller train 34. Thereafter the postcard 45 is fed to between the platen 25 and the thermal head 24 while being nipped between the roller portion 26*b* and the pinch roller trains 34, 37.

On the other hand, as shown in FIG. 3, the second postcard 45' undergoes only the frictional force F2 from the uppermost postcard 45 as the conveying force and therefore cannot overcome the resistance force F4 from the separating projections 41, 42 and cannot ride over the separating projections 41, 42.

By the operation as described above, only the uppermost one of the postcards in the gap L3 is separated and conveyed past the separating projections 41, 42 and, when a postcard is completely fed in this manner, the next uppermost postcard is separated and conveyed in a similar manner.

Description will now be made of a case where recording sheets of ordinary thickness are manually fed one by one.

When manual feeding is to be effected, a recording sheet 50 is placed on the guide surface 39 and pushed downward, as shown in FIG. 1. At this time, a sheet of a width up to maximum L2 can be used as the recording sheet 50. This recording sheet 50 is thin as compared with the postcard 45 and therefore, the leading end edge thereof readily rides onto the separating projections 41 and 42 and arrives at the nip point between the pinch roller train 34 and the sheet feeding roller 26.

If the sheet feeding roller 26 is rotated thereafter, the recording sheet 50 is intactly conveyed to between the platen 25 and the thermal head 24.

As described above, in the present embodiment, by a simple construction in which use is made of the sheet feeding roller 26 having circumferentially extending groove portions 30 and 31 and not so differing from a usually used cylindrical sheet feeding roller and the separating projections 41 and 42 are merely provided on the sheet guide 38, the function of separating and feeding the recording sheets can be readily added to the conventional function of manually feeding the recording sheets one by one. Also, the structure using the separating projections 41 and 42 is not only structurally simplified, but also is suitable for the conveyance of thick recording sheets such as postcards.

Further, in the present embodiment, the position at which recording sheets such as postcards to be automatically separated and fed are mounted corresponds to the recess 38C depressed from the guide surface 39, and this enables a great quantity of recording sheets to be easily mounted. Further, the width L1 of the recess 38C is in accord with the size (148 mm) of a postcard or the like and thus, it is possible to prevent oblique movement or skew of the recording sheets separated and fed one by one.

Figure 4:
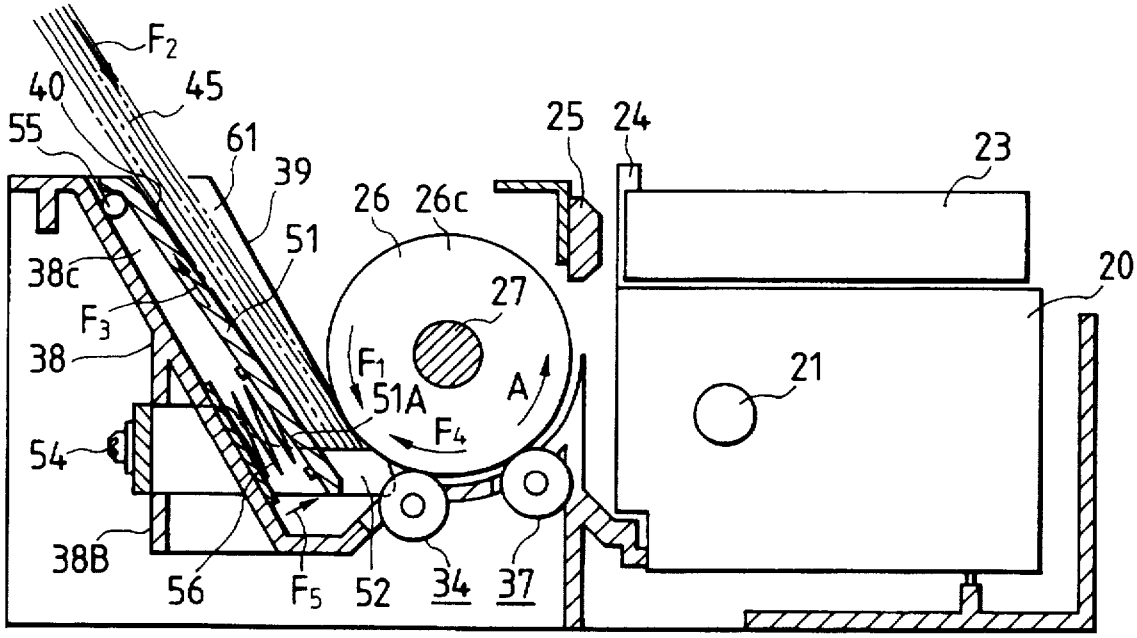
FIGS. 4 and 5 are cross-sectional views of a second embodiment.

FIG. 4 shows another embodiment of the present invention. This embodiment differs from the embodiment of FIGS. 1–3 in that the separating projections are formed separately from the sheet guide 38 and that a pressure plate 51 is provided in the recess 38C of the sheet guide 38, and is identical to the previous embodiment in the other points and therefore need not be described.

As shown, in the second embodiment, the separating projections 52 and 53 (the latter being not shown) are fixed to the beam portion 38B of the sheet guide 38 by a screw 54. These separating projections 52 and 53 are in the same positional relation as the separating projections 42 and 41, and overlap the groove portions 30 and 31 of the sheet feeding roller 26. Accordingly, the position of overlap between the separating projections 52, 53 and the sheet feeding roller 26 is upstream of the nip point between the sheet feeding roller 26 and the pinch roller train 34 with respect to the direction of sheet feeding. If the separating projections 52 and 53 are thus made separate from the sheet guide 38, the shape thereof can be changed in conformity with the material, the number, etc. of the recording sheets used.

On the other hand, in the present embodiment, the recess 38C depressed from the guide surface 39 of the sheet guide 38 is of substantially quadrilateral cross-sectional shape as shown, and the pressure plate 51 is mounted in this recess 38C. This pressure plate 51 is fixed to the sheet guide 38 so as to be pivotable about a shaft 55, and has the free end thereof biased toward the roller portion **26*b* of the sheet feeding roller 26 by a compression spring 56. The position at which the pressure plate 51 strikes against the separating projections 52 and 53 is a cut-away 51A, and no collision takes place between the two. In this manner, the surface of the pressure plate 51 forms a guide surface 40** for thick recording sheets (in this case, postcards).

Figure 5:
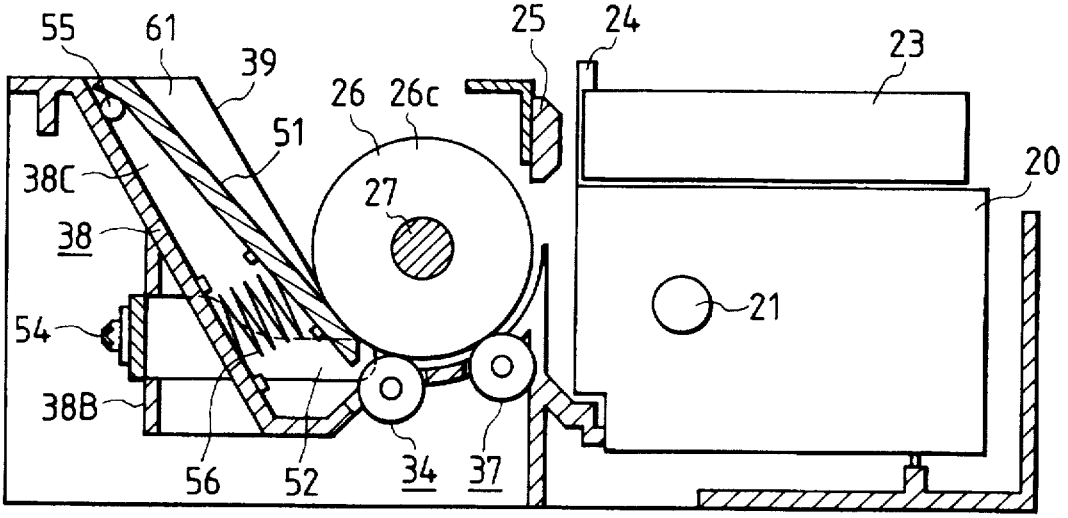
Figure 6:
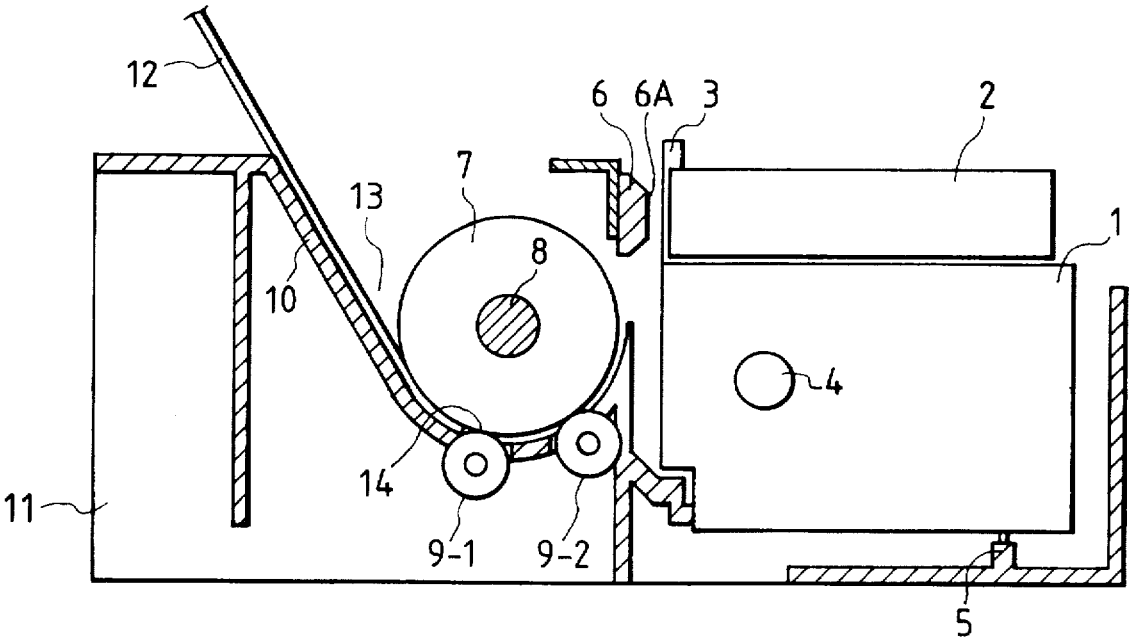
FIG. 6 is a cross-sectional view of an example of the prior art.

With the above-described structure, when the postcards 45 are to be automatically separated and fed, the postcards 45 are pushed into between the pressure plate 51 and the roller portion **26*b* urged against each other, as shown in FIG. 5. FIG. 4 shows the state in which the postcards have been pushed in. In this state, the force F5 of the spring 56 conforming to the thickness of the bundle of postcards 45 acts in a direction, to urge the postcards 45 against the roller portion 26*b*. This force F5 increases the force F1' of the roller portion 26*b* which feeds the uppermost postcard, as compared with F1. The action of separating the postcards 45 is further improved by the action of this force F5**.

Also, as shown in FIG. 5, when no postcard is set on the pressure plate 51, the fore end of the pressure plate 51 protrudes toward the sheet feeding roller 26 beyond the guide surface 39. Thus, the recording sheets will not be caught when they are mounted.

The present invention is not restricted to the above-described embodiments. For example, the heights of the separating projections 41, 42, 52, 53 may be adjusted so that not only recording sheets having widths of l1-L1 can be automatically separated and fed, but also recording sheets having a width of l5 or greater can be fed.

Also, the connecting portions 40 and 41 which connect the guide surface 39 and the guide surface 40 are integral with the sheet guide 38, but alternatively, these connecting portions may be made into removably mountable ribs separate from the sheet guide. If these ribs are made movable to the left and right, it will be possible to cope with recording sheets of various sizes.

FIGS. 8 to 11 show a third embodiment of the present invention.

Figure 10:
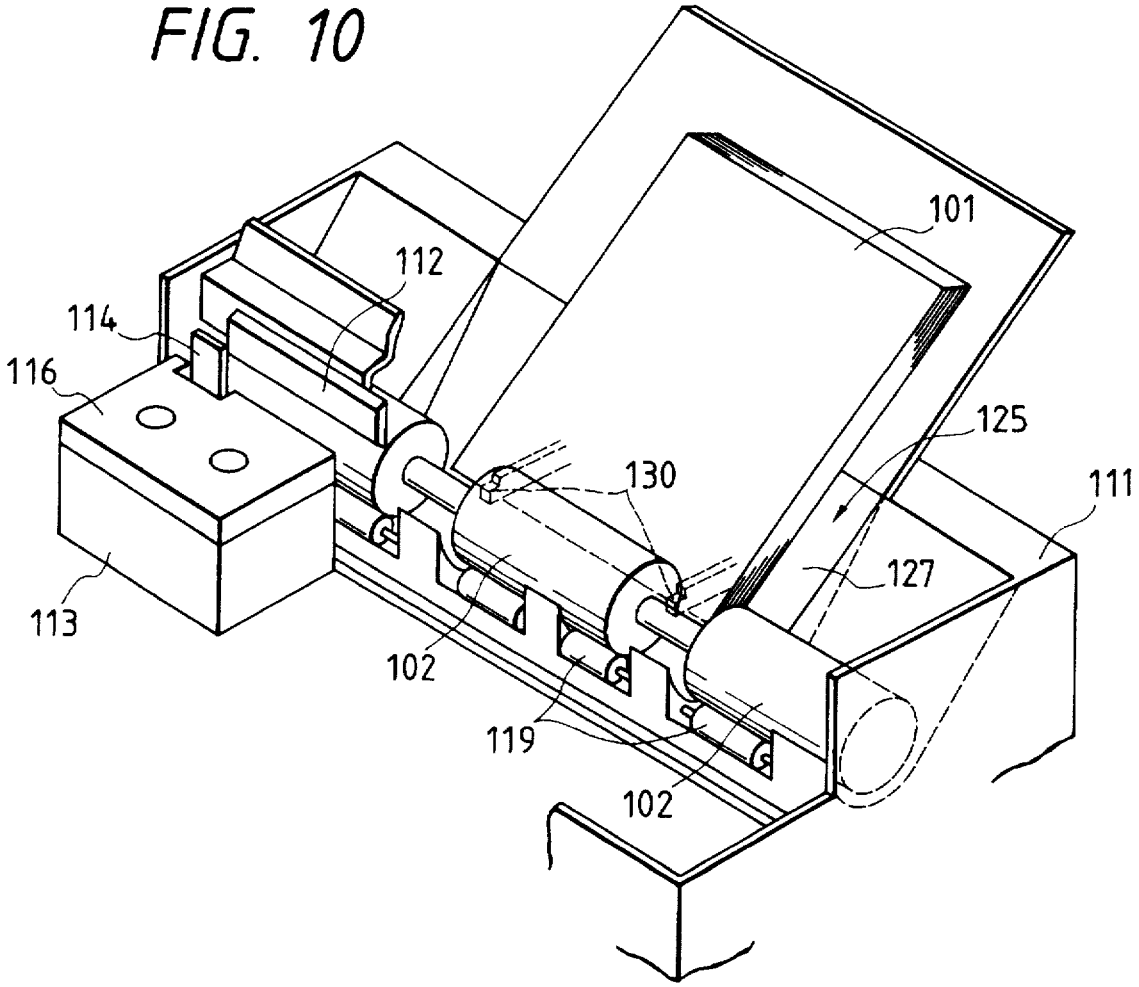
Figure 11:
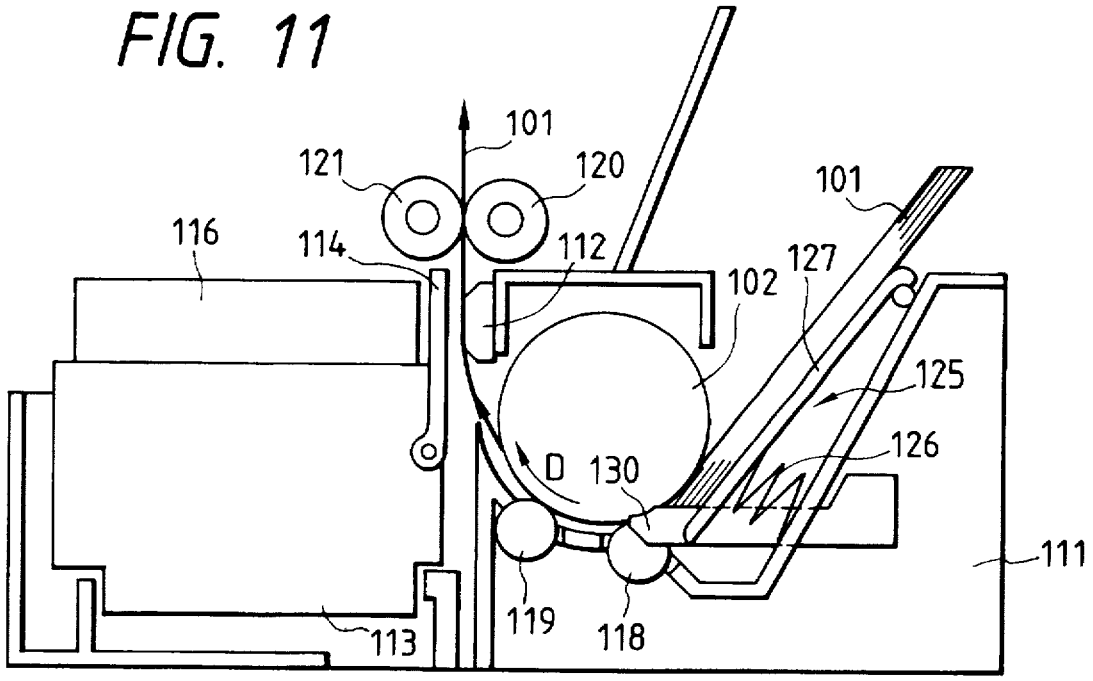

FIG. 10 is a partly broken-away perspective view of a recording apparatus provided with a sheet feeding apparatus according to the third embodiment of the present invention, and FIG. 11 is a central longitudinal sectional view of the FIG. 10 apparatus.

In FIGS. 10 and 11, the reference numeral 111 designates the base of the recording apparatus, and a recording section and a sheet supply mechanism which will hereinafter be described are supported on the base 111.

A horizontally extending platen 112 is fixed, a carriage 113 reciprocally movable along guide means (not shown) in parallelism to the platen 112 is provided forwardly of the platen 112, and a recording head 114 is carried on the carriage 113.

The recording apparatus is exemplarily shown as a heat transfer printer, and the recording head (thermal head) 114 is supported for movement away from and toward sheets (various cut sheets including sheets of small size such as postcards) 101 fed into between the head and the platen 112, and a ribbon cassette 116 for feeding therefrom into between the recording head 114 and the sheet 101 is carried on the carriage 113.

A conveying mechanism comprising a feed roller 102 serving also as the sheet feeding roller of the sheet feeding apparatus which will be described later and pinch rollers 118 and 119 (FIG. 11) is provided upstream of the recording head 114 with respect to the direction of sheet conveyance.

The feed roller 102 is disposed below the platen 112 and is rotatably supported on the base 111 at its opposite ends.

A sheet discharging mechanism comprising a discharge roller 120 and a bail roller 121 as shown in FIG. 11 is provided at the downstream side (the discharge side) of the recording head 114.

An automatic sheet feeding apparatus (an automatic sheet separating and feeding mechanism) 125 for supplying cut sheets 101 such as postcards one by one is provided upstream (rightwardly as viewed in FIG. 11) of the feed roller 102.

This sheet feeding apparatus 125 is of a unitary type which is contained in the recording apparatus, and the sheet feeding roller 102 thereof is identical to the aforementioned feed roller 102.

The sheet feeding apparatus, as shown in FIG. 11, is comprised of a pressure plate 127 urged against the sheet feeding roller 102 by a compression spring 126, and a separating projection 130 mounted on the base 111 side for holding down piled sheets 101 so that the sheets 101 in contact with the sheet feeding roller 102 can ride over.

The piled sheets (such as postcards) 101 are urged against the peripheral surface of the sheet feeding roller 102 with a pressure force P2 (FIG. 8) by the spring-biased pressure plate 127 and are held with their leading end edges held down by the separating projection 130.

The opposite side edges of the piled sheets 101 are guided by a guide mechanism, not shown.

Thus, when the sheet feeding roller 102 is rotated in the direction of arrow D (FIG. 11), the first (uppermost) sheet 101 undergoes a frictional conveying force and rides over the separating projection 130, and is separated from the second and subsequent sheets 101 and supplied to a recording section.

Following the first sheet, the second and subsequent sheets are also separated one by one in the same manner and continuously supplied.

Figure 8:
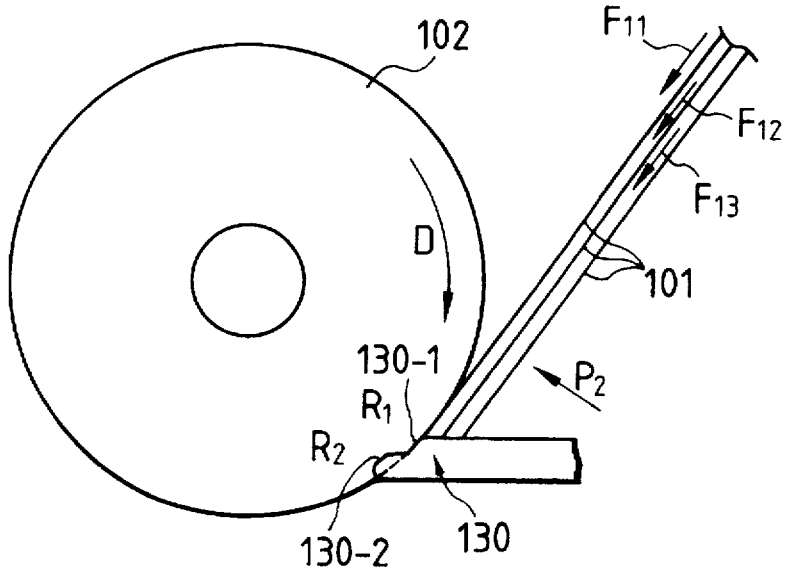
FIGS. 8 to 11 show a third embodiment of the present invention, FIG. 8 being a schematic elevational view showing the essential portions of a sheet feeding apparatus according to the third embodiment, FIG. 9 being a schematic plan view corresponding to FIG. 8, FIG. 10 being a partly broken-away perspective view of a recording apparatus provided with the sheet feeding apparatus of FIG. 8, and FIG. 11 being a central longitudinal sectional view of the recording apparatus of FIG. 10.

FIG. 8 is a schematic illustration showing the essential portions of the sheet feeding apparatus according to the third embodiment.

In FIG. 8, the separating projection 130 is comprised of a plurality of (in the shown example, two) steps of separating projected portions 130-1 and 130-2 differing in the riding-over force.

Figure 7:
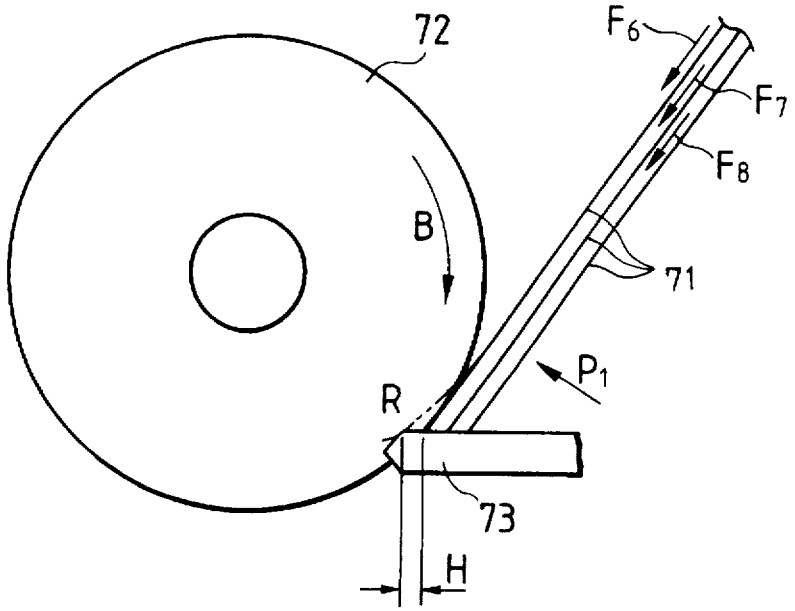
FIG. 7 also is a cross-sectional view of an example of the prior art.

FIG. 8 is an illustration corresponding to FIG. 7 which shows the prior-art structure, and like numerals and like characters in FIGS. 8 and 7 are identical in significance.

The riding-over force of the first step of separating projected portion 130-1 is R1, the riding-over force of the second step of separating projected portion 130-2 is R2, and the amount of overlap of these separating projected portions with the sheet feeding roller 102 is set so that the riding-over force of the first step is smaller, that is, $R1<R2$.

Figure 9:
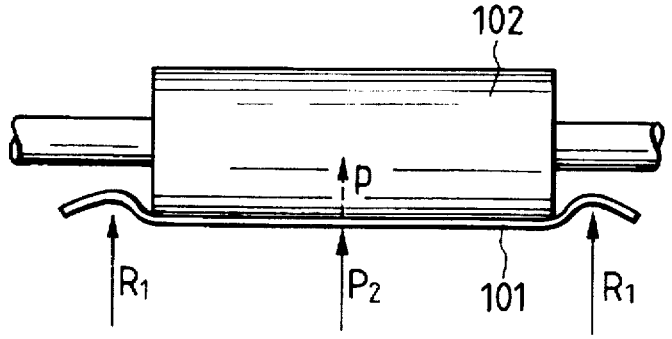

FIG. 9 is a schematic illustration showing a force which acts on the sheet 101 immediately after the leading end edge of the sheet 101 has ridden over the first step of separating projected portion 130-1.

According to the structure of the aforedescribed embodiment, the separating projection 130 is comprised of two steps of projected portions 130-1 and 130-2 differing in the riding-over force and therefore, the following operational effects have been obtained in respective environments.

(1) Where the environment is of low temperature and low humidity

In this case, because of the great rigidity of the sheets (such as postcards) 101, one sheet can be easily separated on the first step even if the riding-over force R1 of the first step 130-1 is small.

Further, because of the great rigidity of the sheets 101, there is created a force p with which the sheet 101 tries to restore its original planarity as shown in FIG. 9 by having ridden over the first step 130-1, and the pressure force of the sheet 101 relative to the sheet feeding roller 102 increases from P2 to (P2+p).

Therefore, the frictional conveying force $F11\{=\mu1(P2+p)\}$ by the sheet feeding roller 102 on the second step 130-2 becomes great and correspondingly, the amount of overlap between the second step of separating projected portion 130-2 and the sheet feeding roller 102 can be made great, whereby the riding-over force R2 of the second step can be increased.

(2) Where the environment is of high temperature and high humidity

In this case, the rigidity of the postcards is low and $\mu2$ is great and therefore, two or more postcards may be fed over the first step 130-1 at a time.

However, even if two or more sheets (such as postcards) 101 pass over the first step 130-1 at a time, only the first sheet can be separated on the second step 130-2 and accurately fed because the riding-over force R2 of the second step 130-2 is greater than the riding-over force R1 of the first step 130-1.

In an environment of high temperature and high humidity, the rigidity of the sheets (such as postcards) 101 is low and therefore, the force p with which the sheets try to restore their original state may be considered to be substantially zero, and the pressure force of the sheets relative to the sheet feeding roller 102 hardly increases.

Thus, according to the sheet feeding apparatus of the present embodiment having the separating projection 130 shown in FIG. 8, even when the environment changes greatly from low temperature and low humidity to high temperature and high humidity, it has become possible to maintain a stable sheet separating and feeding performance.

Although in the embodiment shown, the separating projection 130 is provided with two steps of projected portions 130-1 and 130-2 differing in the riding-over force, it is also possible to provide three or more projected portions differing in the riding-over force as required.

The present invention is applicable not only to the sheet feeding apparatus of the type contained in the recording apparatus as shown, but also is equally applicable to a removably mountable type cut sheet feeder separate from the recording apparatus and can achieve similar operational effects.

A fourth embodiment of the present invention will now be described with reference to FIGS. 12 to 15.

Figure 12:
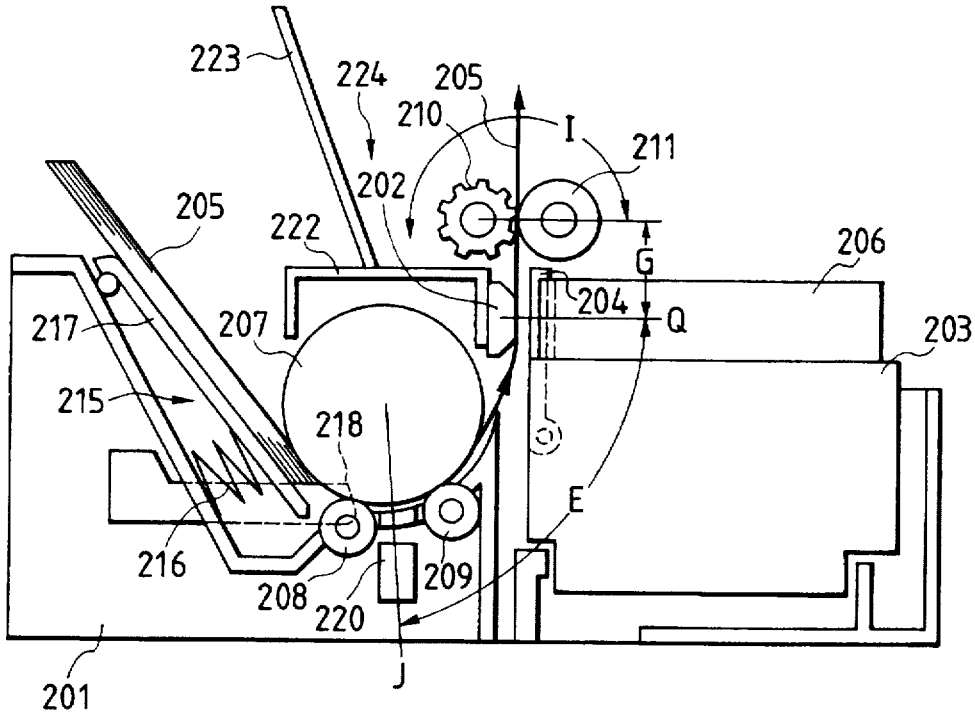
FIGS. 12 to 15 show a fourth embodiment of the present invention, FIG. 12 being a central longitudinal sectional view of a recording apparatus according to the fourth embodiment, FIG. 13 being a partly broken-away perspective view of the recording apparatus of FIG. 12, FIG. 14 being a block diagram of the control system of the recording apparatus of FIG. 12, and FIG. 15 being a flow chart showing the operation procedure.
Figure 13:
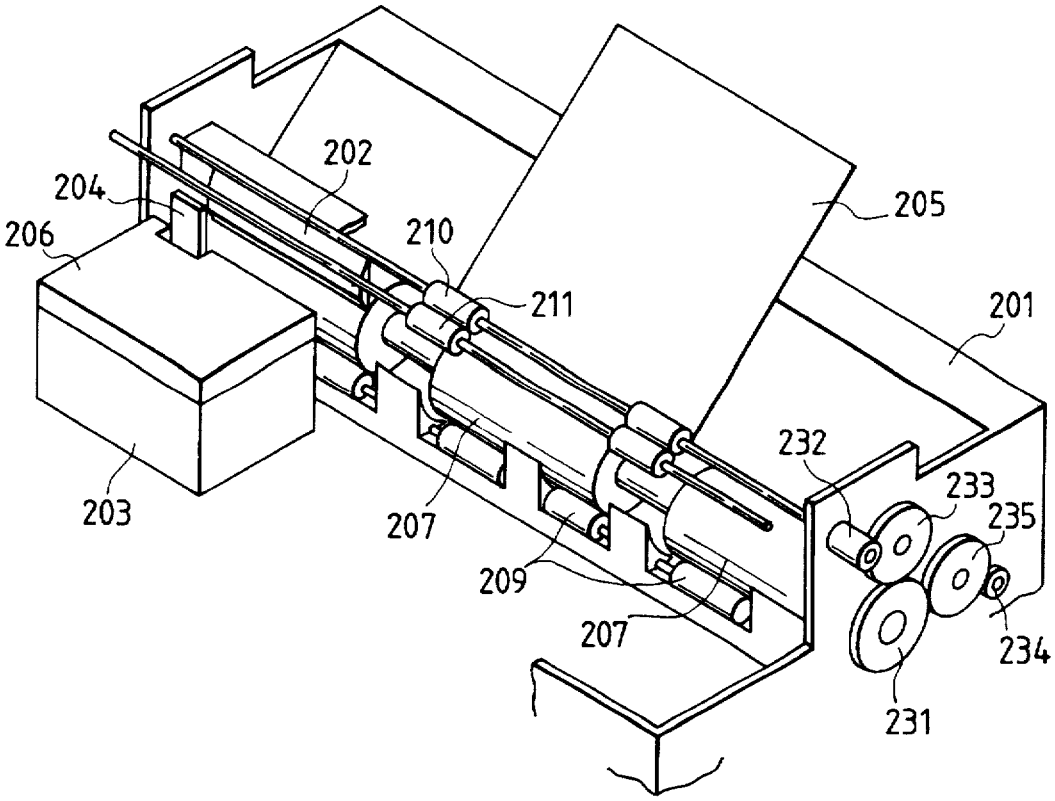

FIG. 12 is a central longitudinal cross-sectional view of a recording apparatus in which the fourth embodiment is carried out, and FIG. 13 is a partly broken-away perspective view of the recording apparatus of FIG. 12.

In FIGS. 12 and 13, the reference numeral 201 designates the base (or frame) of the recording apparatus, and a recording section and a sheet feeding apparatus which will hereinafter be described are supported on the base 201.

A horizontally extending platen (in the shown example, a planar platen) 202 is fixed, a carriage 203 reciprocally movable along guide means (not shown) in parallelism to the platen 202 is provided forwardly of the platen 202, and a recording head 204 is carried on the carriage 203.

The recording apparatus is exemplarily shown as a heat transfer printer, and the recording head (thermal head) 204 is supported for movement away from and toward a sheet 205 fed into between the head and the platen 202, and a ribbon cassette 206 for feeding therefrom an ink ribbon to between the recording head 204 and the sheet 205 is carried on the carriage 203.

First conveying means comprising a feed roller 207 and pinch rollers 208 and 209 adapted to be urged against the feed roller 207 is provided upstream of the recording head 204 with respect to the direction of sheet conveyance (the direction of the arrow indicated on the sheet 205 in FIG. 12).

The feed roller 207 is disposed below the platen 202 and is rotatably supported on the base 201 at the opposite ends thereof.

Second conveying means comprising a discharge roller 210 driven at the same amount of conveyance as the feed roller 207 and a follower roller 211 adapted to be urged against the discharge roller is provided rearwardly (in the shown example, upstream) of the recording head 204 with respect to the direction of sheet conveyance.

In FIG. 12, an automatic sheet separating and feeding mechanism 215 which is an automatic sheet feeding apparatus for supplying cut sheets 205 one by one is provided upstream (in the shown example, leftwardly) of the feed roller 207.

This automatic sheet separating and feeding mechanism 215 is comprised of a pressure plate 217 urged against the feed roller 207 by a spring 216, a separating pawl 218 which is mounted on the base 201 side and by which a sheet 205 in contact with the feed roller 207 is caught for riding over the pawl, and the feed roller 207 serving also as a separating roller (or a sheet feeding roller).

The piled cut sheets 205 are urged against the peripheral surface of the feed roller 207 by the pressure plate 217 and are held with their leading end edges stopped by the separating pawl.

The opposite side edges of the piled cut sheets 205 are guided by a guide plate, not shown.

Thus, when the feed roller 207 is rotated, the uppermost cut sheet 205 may be fed out over the separating pawl 218 so that the cut sheets may be separated one by one and continuously conveyed.

A sheet sensor 220 for detecting the leading end edge of each sheet 205 being conveyed and outputting the information for the control of the heading (to the printing position) of the sheet 205 is provided halfway of the conveyance path of the sheet 205 (in the case of FIG. 12, between the two pinch rollers 208 and 209).

Further, in FIG. 12, a paper supporter 223 is studded on the upper surface of the cover 222 of the recording apparatus, and a stacker 224 for temporarily stacking thereon the sheets 205 discharged by the discharge roller 210 is formed by these.

Referring to FIG. 13, a feed gear 231 is mounted on the shaft portion of the feed roller 207, a discharge gear 232 is mounted on the shaft portion of the discharge roller 210, and the feed gear 231 and the discharge gear 232 are gear-coupled so as to be operatively associated with each other through an idler gear 233.

The feed gear 231 is gear-coupled to a drive gear 234 driven by a sheet feeding motor (not shown), through an idler gear 235.

The ratio of number of teeth between the feed gear 231 and the discharge gear 232 is so set that the amount of sheet conveyance is the same for the feed roller 207 and the discharge roller 210.

Thus, the feed roller 207 serving also as a separating roller and the discharge roller 210 rearwardly of the recording head 204 are designed such that they are simultaneously driven at the same amount of sheet conveyance and both of them perform the sheet conveying function.

In FIG. 12, E indicates the distance between the sheet sensor 220 and a predetermined position Q near the recording section (the recording head 204), G indicates the distance between said predetermined position Q and the discharge roller 210, I indicates the tangential distance over which the discharge roller 210 is further rotated to discharge the sheet 205 completely after the trailing end edge of the sheet has passed the discharge roller 210, J indicates the position of the sheet sensor, and Q indicates said predetermined position near the recording section.

In the sheet feeding operation of the above-described recording apparatus, control is effected so that after the recording of the first sheet 205 has been completed (at this time, the trailing end edge of the first sheet and the leading end edge of the second sheet are, for example, at the position Q), the feed roller 207 and the discharge roller 210 are further rotated in the forward direction over a distance G+I to thereby discharge the first sheet 205 completely, whereafter the feed roller 207 and the discharge roller 210 are rotated in the reverse direction over a distance E+α (α indicates some amount) exceeding the distance E to thereby feed the second sheet 205 reversely until the reading end edge thereof comes to the upstream side of the sheet sensor 220, and then the heading of the second sheet 205 is effected.

Figure 14:
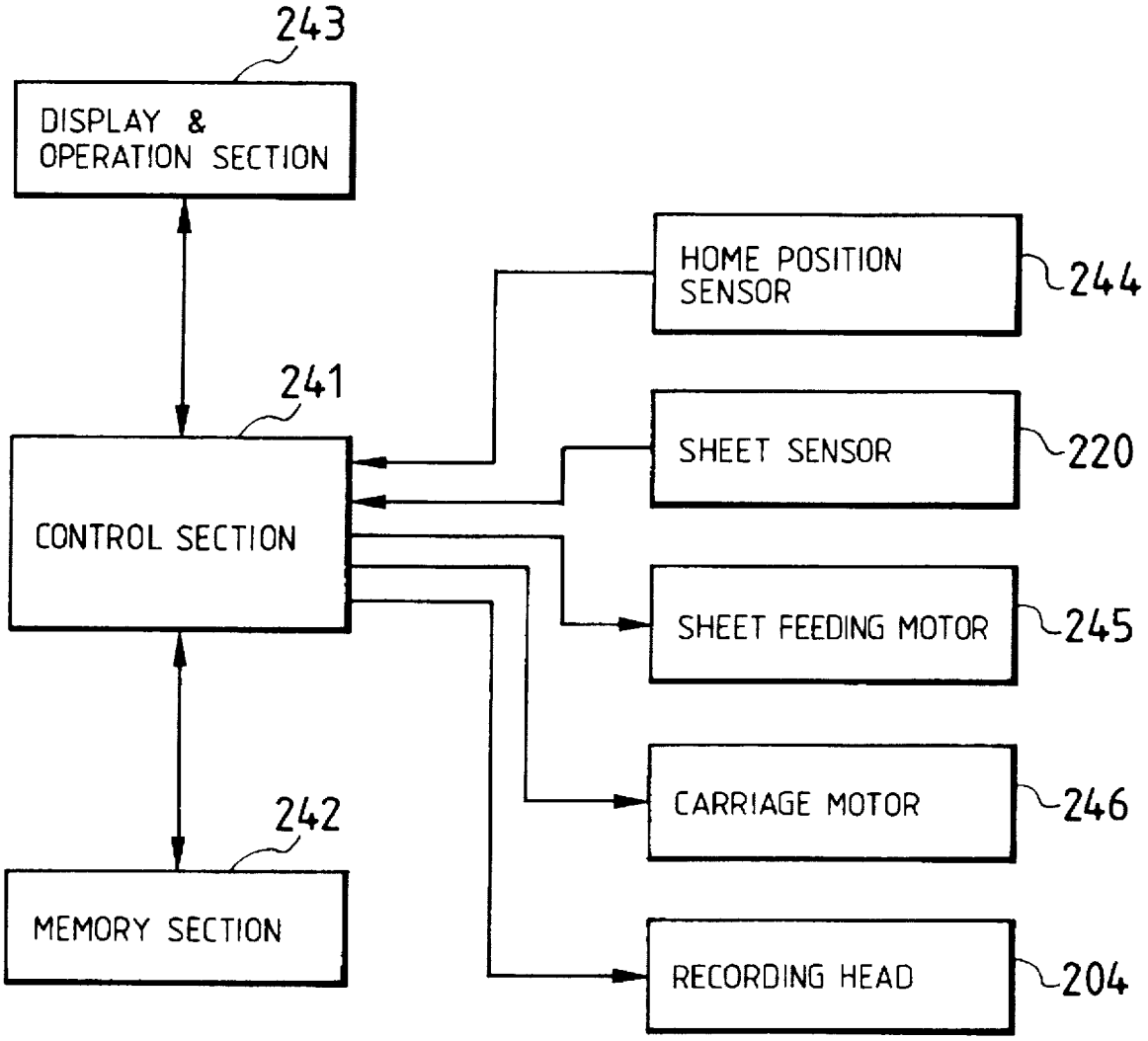

FIG. 14 is a block diagram schematically showing the construction of the control section of the above-described recording apparatus.

In FIG. 14, the control section 241 of the recording apparatus is connected to a memory section 242 and a display and operation section 243 so as to provide an input and an output mutually therebetween and is designed so as to receive detection signals from a home position sensor 244 and said sheet sensor 220 (FIG. 12) and control a sheet feeding motor 245, a carriage motor 246 and the recording head through an unshown driver (a driving circuit).

Figure 15:
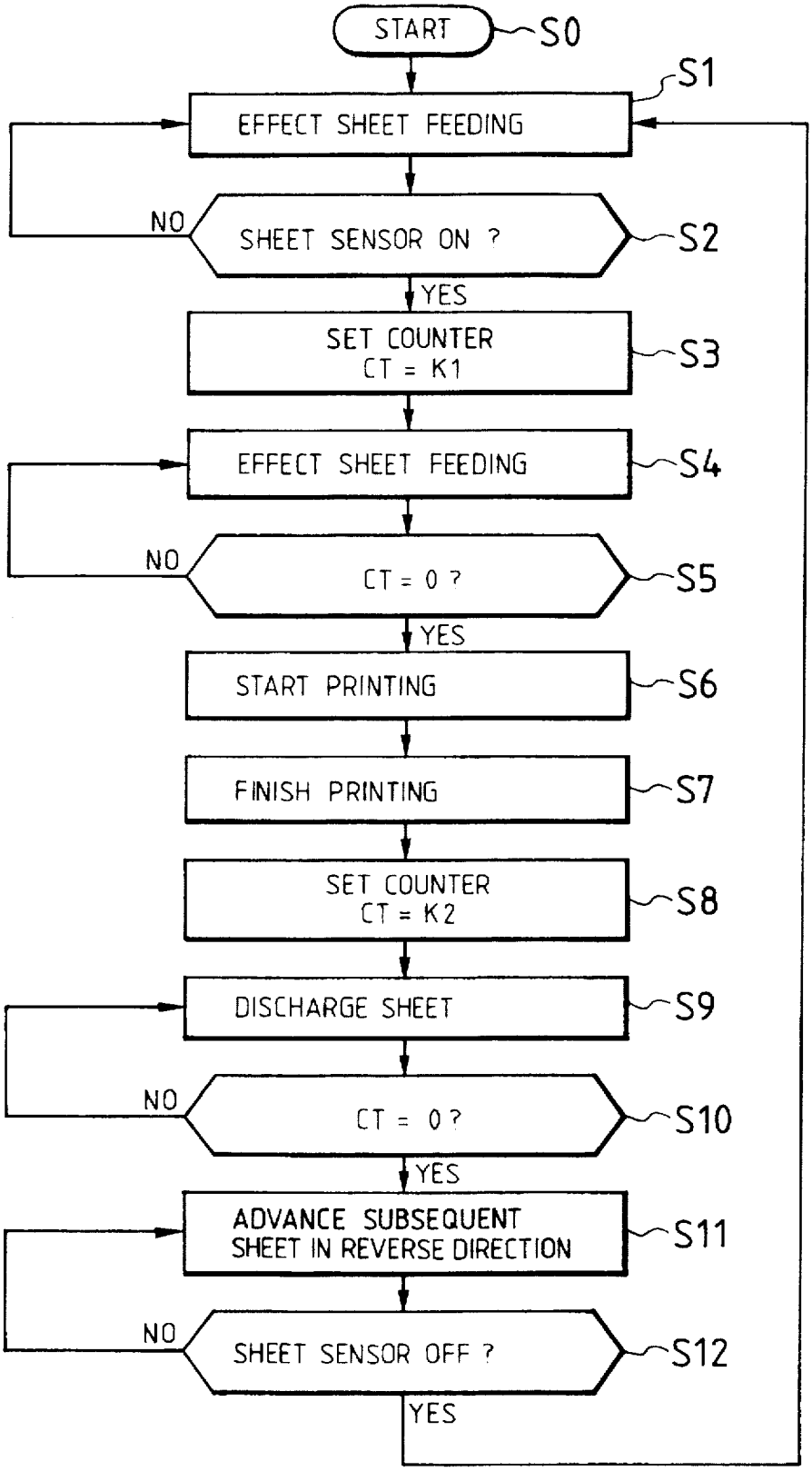

FIG. 15 is a flow chart showing the operation procedure of the recording apparatus of FIGS. 12–14.

In FIG. 15, when the recording operation is started at step S0, the automatic sheet separating and feeding mechanism 215 (FIG. 12) is operated at step S1, and at step S2, whether the leading end edge of the sheet has passed the sheet sensor 220 (FIG. 12) and the sheet sensor 222 has become ON is discriminated.

If the sheet sensor 220 is not ON, the sheet feeding operation of step S1 is continued, and if the sheet sensor 220 becomes ON, advance is made to step S3, where the setting of a counter (CT=K1) for heading is effected.

Further, at step S4, sheet conveyance (sheet feeding) is continued, and at step S5, whether the heading of the sheet has been finished, that is, whether the sheet has arrived at the printing start position and CT=0, is discriminated.

If CT is not CT=0, sheet feeding is continued, and if CT becomes CT=0, advance is made to step S6, where printing (recording) is started.

When recording on the first sheet is finished (step S7), advance is made to step S8, where the setting of the counter (CT=K2) for the calculation of the amount of sheet conveyance is effected.

At this time, the trailing end edge of the first sheet and the leading end edge of the second sheet lie, for example, at the position Q near the printing section shown in FIG. 12.

Advance is then made to step S9, where both the first sheet and the second sheet are conveyed in the discharge (forward) direction, and at step S10, whether the counter value has become CT=0, that is, whether the first sheet has been conveyed until it is completely discharged (the distance G+I in FIG. 12 ), is discriminated.

If the first sheet is not completely discharged, the discharging operation is continued, and if it is completely discharged (CT=0), advance is made to step S11, where the discharge roller 210 and the feed roller 207 are rotated in the reverse direction to feed the second sheet reversely.

At step S11, feeding the sheet in the reverse direction is effected, and at step S12, whether the sheet sensor 220 has become OFF, that is, whether the amount of reverse feeding has exceeded E in FIG. 12 and the leading end edge of the second sheet has passed the sheet sensor 220, is repetitively discriminated.

When the leading end edge of the second sheet shifts to the upstream side of the sheet sensor 220 and the sheet sensor 220 becomes OFF, the operation of feeding the sheet in the reverse direction is stopped and return is made to step S1, where the above-described operations are executed for the second sheet (which, at this point of time, is the first sheet) and the next sheet.

By the above-described operation procedure being repeated, the cut sheets 205 are continuously separated and fed and recording is effected.

The above-described embodiment can be carried out in various recording apparatuses of the type containing therein an automatic sheet separating and feeding mechanism having a feed roller serving also as a separating roller, irrespective of the kind of the recording apparatus such as an ink jet printer, a wire dot printer, a laser beam printer or a typewriter (type printing), and irrespective of the type of the scanning system such as the serial print type or the line print type, and further irrespective of the number of recording heads in a color printer or the like.

Figure 16:
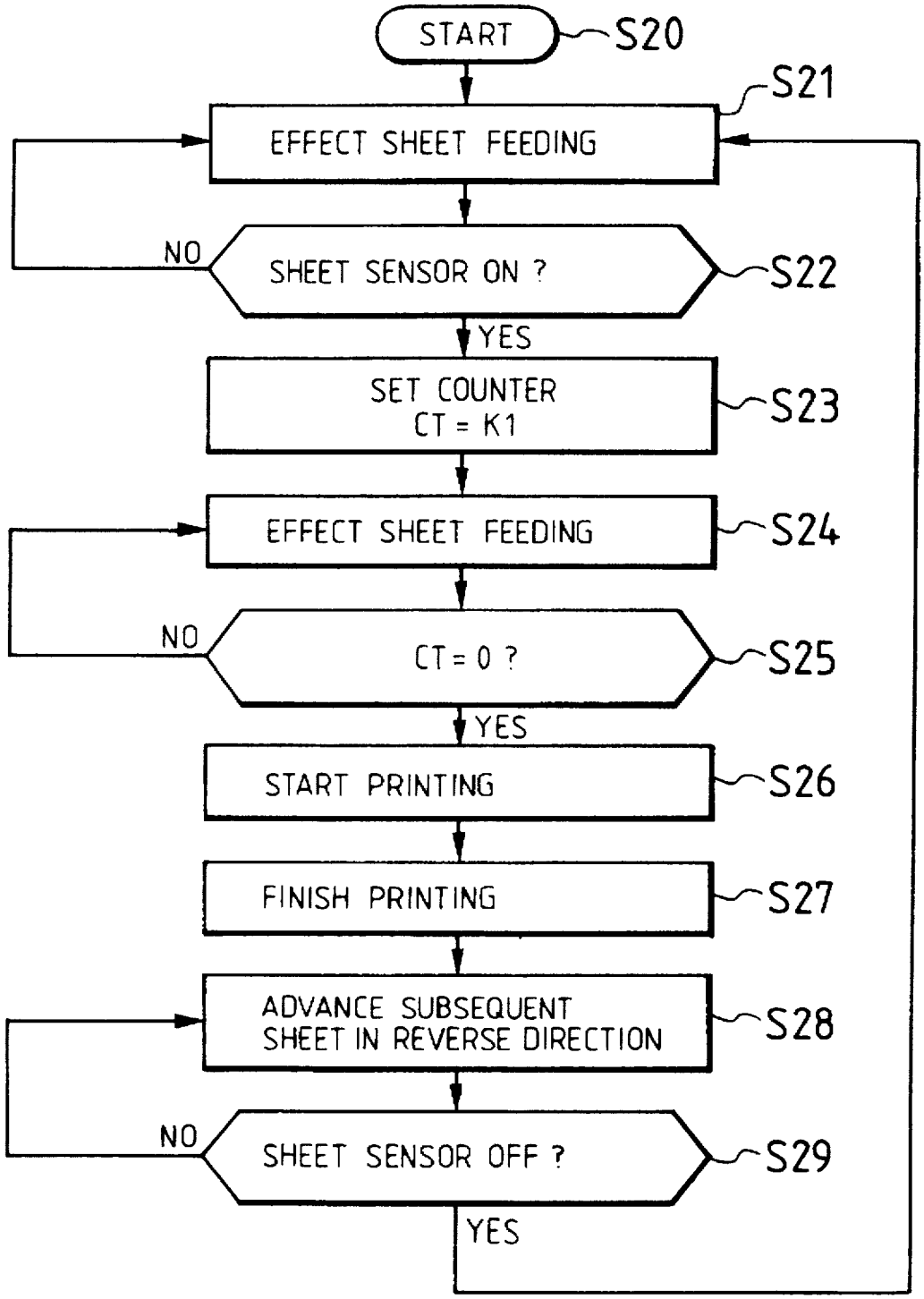
FIG. 16 is a flow chart showing the operation procedure of a fifth embodiment of the present invention.

A fifth embodiment of the present invention will now be described with reference to FIG. 16. The fifth embodiment is substantially the same as the fourth embodiment shown in FIGS. 12–14, and the difference thereof from the fourth embodiment is the content of the memory section 242. The details of the content of the memory section 242 are shown in FIG. 16. Briefly describing, in the sheet feeding operation of the present embodiment, control is effected so that after recording of the first sheet 205 has been completed (at this time, the trailing end edge of the first sheet and the leading end edge of the second sheet lie, for example, at the position Q), the feed roller 207 is driven in the reverse direction (the discharge roller 210 is stopped) and only the second sheet 205 is fed in the reverse direction over a distance E+α (α indicates some amount) exceeding the distance E, whereby the second sheet is returned until its leading end edge comes to lie on the upstream side of the sheet sensor 220, and said leading end edge is detected, whereafter the feed roller 207 is driven in the forward direction and the discharge roller 210 is also driven in the forward direction at the same amount of conveyance, whereby discharging of the first sheet and the heading of the second sheet (setting of the second sheet at the printing start position) are simultaneously effected.

In this case, it is necessary that in order to enable the first sheet to be completely discharged, the amount of reverse feeding E+α of the second sheet be set to greater than the distance G+I over which the first sheet is completely discharged from the position Q.

Description will now be made in detail with reference to FIG. 16.

In FIG. 16, when the recording operation is started at step S20, the automatic sheet separating and feeding mechanism 215 (FIG. 12) is operated at step S21, and at step S22, whether the leading end edge of the sheet has passed the sheet sensor 220 (FIG. 12) and the sheet sensor has become ON is discriminated.

If the sheet sensor 220 is not ON, the sheet feeding operation of step S21 is continued, and if the sheet sensor becomes ON, advance is made to step S23, where the setting of the counter (CT=K1) for heading is effected.

Further, at step S24, sheet conveyance (sheet feeding) is continued, and at step S25, whether the heading of the sheet has been finished, that is, whether the sheet has arrived at the printing start position and CT has become CT=0, is discriminated.

If CT iS not CT=0, sheet feeding is continued, and if CT becomes CT=0, advance is made to step S26, where printing (recording) is started.

At step S27, printing for the first sheet is finished. At this time, the trailing end edge of the first sheet and the leading end edge of the second sheet lie at the predetermined position Q near the recording section in FIG. 12.

After the printing (recording) for the first sheet has thus been finished, advance is made to step S28, where the feed roller 207 is driven in the reverse direction to feed only the second sheet in the reverse direction. At this time, the discharge roller 210 is rendered into power-off condition by a one-way clutch and stopped, and the first sheet is held at the position when recording has been finished (the trailing end edge of the first sheet is at the position Q).

The reversely feeding operation of step S28 is continued, and at step S29, whether the sheet sensor 220 has become OFF, that is, whether the amount of reverse feeding of the second sheet has exceeded the distance E in FIG. 12 and reached E+α and the leading end edge of this sheet has moved to the upstream side of the sheet sensor 220, is discriminated.

At step S29, the sheet sensor 220 becomes OFF and the reversely feeding operation is stopped at a point of time whereat the second sheet has been fed reversely by the distance E+α.

Thereafter, return is made to the sheet feeding operation of step S21, where the feed roller 207 is driven in the forward direction, whereby the discharge roller 210 is also driven in the forward direction at the same amount of conveyance and at the same time, and discharging of the first sheet and heading of the second sheet are effected simultaneously.

In this case, the amount of conveyance E+α for effecting the heading of the second sheet is set to equal to or greater than the distance G+I necessary to discharge the first sheet completely and therefore, the first sheet is completely discharged while the second sheet is being fed.

After the discharging of the first sheet has been completed, the second sheet becomes the top sheet (the first sheet during the next sheet feed) and the next sheet continuously separated and fed becomes the second sheet, and the operations described above are executed again.

By the above-described operation procedure being repeated, the cut sheets 205 are continuously separated and fed and recording is effected.

According to the above-described sheet feed control method, it has become possible in a recording apparatus of the type containing an automatic sheet separating and feeding mechanism provided with a feed roller serving also as a separating roller to accomplish the heading of the second and subsequent sheets automatically and moreover smoothly without exposing them to the outside in a small distance of reciprocation.

We claim:

1. A sheet feeding apparatus comprising:

sheet feeding means comprising a sheet supply roller;

guide means comprising first and second guide surfaces of a first height separated in a lateral direction of a sheet for guiding large-sized sheets to said sheet feeding means, and a third guide surface of a second height lower than the first height disposed between said first and second guide surfaces for guiding small-sized sheets to said sheet feeding means; and a pair of protruding portions protruding from one of said guide surfaces to be positioned at both sides of said sheet supply roller for flexing lateral portions of the sheet, each of said pair of protruding portions having an abutment surface to which a leading end of a sheet guided by said third guide surface is abutted, and each of said pair of protruding portions having a tip with a tip end, each of said tip ends of said pair of protruding portions extending to a position near to a rotation center of said sheet supply roller beyond an outer surface of said sheet supply roller where said sheet supply roller contacts the sheet, wherein, when a sheet stack is loaded on said guide surfaces, an uppermost sheet, to which a sheet supply force is applied directly by said sheet supply roller, rides over said pair of protruding portions at a leading end thereof and is bent to pass through a gap between said side surfaces of said sheet supply roller and said protruding portions at side peripheries thereof in order to be separated from the sheet stack, while sheets other than the uppermost sheet, which are not applied the sheet supply force directly by said sheet supply roller, abut against said pair of protruding portions.

2. A sheet feeding apparatus according to claim 1, wherein said guide means includes a guide member which has a surface for forming said third guide surface, and said apparatus further includes a press means for pressing said guide member toward said sheet supply roller.

3. A sheet feeding apparatus according to claim 1, further including side guide means for guiding a side periphery of a sheet, said side guide means being provided between said first guide surface and said third guide surface.

4. A sheet feeding apparatus according to claim 1, further comprising press means for pressing the sheet guided by said third guide surface toward said sheet feeding means.

5. An image forming apparatus comprising:

sheet guide means having a guide surface for guiding a sheet;

a sheet supply roller for supplying the sheet guided by said sheet guide means;

a pair of protruding portions protruding from the guide surface to be positioned at both sides of said sheet supply roller, each of said pair of protruding portions having an abutment surface to which a leading end of the sheet is abutted and each of said pair of protruding portions having a tip with a tip end, each of said tip ends of said pair of protruding portions extending to a position near to a rotation center of said sheet supply roller beyond an outer surface of said sheet supply roller where said sheet supply roller contacts the sheet, and a distance between each of said tip ends of said pair of protruding portions and the axis of rotation of said sheet supply roller is shorter than a distance between the outer surface of said sheet supply roller contacting the sheet and the axis of rotation of said sheet supply roller; and image forming means for forming an image onto the sheet supplied by said sheet supply roller, wherein, when a sheet stack is loaded on the guide surface, an uppermost sheet, to which a sheet supply force is applied directly by said sheet supply roller, rides over said pair of protruding portions at the leading end thereof and is bent to pass through a gap between side surfaces of said sheet supply roller and said protruding portions at side peripheries thereof in order to be separated from the sheet stack, while sheets other than the uppermost sheet, which are not applied the sheet supply force directly by said sheet supply roller, abut against said pair of protruding portions.

6. An image forming apparatus comprising:

sheet feeding means comprising a sheet supply roller;

guide means comprising first and second guide surfaces of a first height for guiding large-sized sheets to said sheet feeding means, and a third guide surface of a second height lower than the first height disposed between said first and second guide surfaces for guiding small-sized sheets to said sheet feeding means;

a pair of protruding portions protruding from one of said guide surfaces to be positioned at both sides of said sheet supply roller, each of said pair of protruding portions having an abutment surface to which a leading end of the sheet guided by the third guide surface is abutted, and each of said pair of protruding portions having a tip with a tip end, each of said tip ends of said pair of protruding portions extending to a position near to a rotation center of said sheet supply roller beyond an outer surfaced of said sheet supply roller where said sheet supply roller contacts the sheet, and a distance between each of said tip ends of said pair of protruding portions and the axis of rotation of said sheet supply roller is shorter than a distance between the outer surface of said sheet supply roller contacting the sheet and the axis of rotation of said sheet supply roller; and image forming means for forming an image on the sheet fed by said sheet feeding means, wherein, when a sheet stack is loaded on said guide surfaces, and uppermost sheet, to which a sheet supply force is applied directly by said sheet supply roller, rides over said pair of protruding portions at the leading end thereof and is bent to pass thorough a gap between side surfaces of said sheet supply roller and said protruding portions at side peripheries thereof in order to be separated from the sheet stack, while sheets other than the uppermost sheet, which are not applied the sheet supply force directly by said sheet supply roller, abut against said pair of protruding portions.

7. An image forming apparatus according to claim 6, further comprising press means for pressing the sheet guided by said third guide surface against said sheet feeding means.

8. A sheet feeding apparatus comprising:

sheet guide means having a guide surface for guiding a sheet;

a sheet supply roller for supplying the sheet guided by said sheet guide means; and a pair of protruding portions protruding from the guide surface to be positioned at both sides of said sheet supply roller, each of said pair of protruding portions having an abutment surface to which a leading end of the sheet is abutted, and each of said pair of protruding portions having a tip with a tip end, each of said tip ends of said pair of protruding portions extending to a position near to a rotation center of said sheet supply roller beyond an outer surface of said sheet supply roller where said sheet supply roller contacts the sheet, and a distance between each of said tip ends of said pair of protruding portions and the axis of rotation of said sheet supply roller is shorter than a distance between the outer surface of said sheet supply roller contacting the sheet and the axis of rotation of said sheet supply roller, wherein, when a sheet stack is loaded on the guide surface, an uppermost sheet, to which a sheet supply force is applied directly by said sheet supply roller, rides over said pair of protruding portions at a leading end thereof and is bent to pass through a gap between side surfaces of said sheet supply roller and said protruding portions at side peripheries thereof in order to be separated from the sheet stack, while sheets other than the uppermost sheet, which are not applied the sheet supply force directly by said sheet supply roller, abut against said pair of protruding portions.

9. A sheet feeding apparatus according to claim 8, wherein the height of said protruding portions is set so that a first recording sheet having a first thickness readily passes between said protruding portions and said sheet supply roller and a stack of second recording sheets having a second thickness are separated and fed one by one by rotation of said sheet supply roller.

10. A sheet feeding apparatus according to claim 9, wherein the second thickness is larger than the first thickness.

11. A sheet feeding apparatus according to claim 8, wherein each of said protruding portions has a first protruded portion and a second protruded portion which protrudes further toward circumferentially extending groove portions formed in a lengthwisely, intermediate portion of said sheet supply roller than said first protruded portion.

12. A sheet feeding apparatus according to claim 8, further comprising press means for pressing a sheet guided by said guide means toward said sheet supply roller.

13. A sheet feeding apparatus according to claim 12, wherein said guide means includes a guide member which has a surface for guiding the sheet, said press means pressing said guide member toward said sheet supply roller.

14. A sheet feeding apparatus according to claim 8, wherein said guide means has a guide member for guiding a bottom surface of the sheet stack, and a side guide member for guiding a side edge of the sheet stack so that the side edge protrudes from said sheet supply roller in a lateral direction thereof.

15. A sheet feeding apparatus according to claim 8, further comprising bias means for biasing the guide surface against said sheet supply roller via the sheet stack.

16. A sheet feeding apparatus according to claim 8, wherein each protruding portion has a first protrusion portion protruding toward said sheet supply roller, and a second protrusion portion protruding toward said sheet supply roller by an amount larger than said first protrusion portion.

17. A sheet feeding apparatus according to claim 8, wherein said sheet supply roller comprises a first roller, each of said pair of protruding portions being disposed on either side of said first roller, and each of a second and a third roller being disposed on a side of one of said pair of protruding portions, respectively, opposite to a side on which said first roller is disposed.

18. A sheet feeding apparatus according to claim 17, further comprising second and third guide surfaces in position at both side areas and higher than the guide surface, said second and third guide surfaces cooperating to guide a sheet larger than the guide to said first, second and third rollers.

19. A sheet feeding apparatus comprising:

sheet guide means having a guide surface for guiding a sheet;

a sheet supply roller for supplying the sheet guided by said sheet guide means; and a protruding portion protruding from the guide surface, said protruding portion having an abutment surface to which a leading end of the sheet guided by said guide means is abutted, and said protruding portion having a tip with a tip end, said tip end of said protruding portion extending to a position near to a rotation center of said sheet supply roller beyond an outer surface of said sheet supply roller where said sheet supply roller contacts the sheet, and a distance between said tip end of said protruding portion and the axis of rotation of said sheet supply roller is shorter than a distance between the outer surface of said sheet supply roller contacting the sheet and the axis of rotation of said sheet supply roller, wherein, when a sheet stack is loaded on the guide surface, an uppermost sheet, to which a sheet supply force is applied by said sheet supply roller, rides over said protruding portion at a leading end thereof and is bent to pass through a gap between a side surface of said sheet supply roller and said protruding portion at a side periphery thereof in order to be separated from the sheet stack, while sheets other than the uppermost sheet, which are not applied the sheet supply force directly, abut against said protruding portion.

20. An image forming apparatus comprising:

sheet guide means having a guide surface for guiding a sheet;

a sheet supply roller for supplying the sheet guided by said sheet guide means;

a protruding portion protruding from the guide surface, said protruding portion having an abutment surface to which a leading end of the sheet is abutted, and said protruding portion having a tip with a tip end, said tip end of said protruding portion extending to a position near to a rotation center of said sheet supply roller beyond an outer surface of said sheet supply roller where said sheet supply roller contacts the sheet, and a distance between said tip end of said protruding portion and the axis of rotation of said sheet supply roller is shorter than a distance between the outer surface of said sheet supply roller contacting the sheet and the axis of rotation of said sheet supply roller; and image forming means for forming an image on the sheet supplied by said sheet supply roller, wherein, when a sheet stack is loaded on the guide surface, an uppermost sheet, to which a sheet supply force is applied directly by said sheet supply roller, rides over said protruding portion at a leading end thereof and is bent to pass through a gap between a side surface of said sheet supply roller and said protruding portion at a side periphery thereof in order to be separated from the sheet stack, while sheets other than the uppermost sheet, which are not applied the sheet supply force directly by said sheet supply means, abut against said protruding portion.

* * * * *

UNITED STATES PATENT AND TRADEMARK OFFICE

CERTIFICATE OF CORRECTION

PATENT NO. : 5,593,150

DATED : January 14, 1997

INVENTOR(S) : Katayanagi et al.

It is certified that error appears in the above-indentified patent and that said Letters Patent is hereby corrected as shown below:

COLUMN 6:

Line 32, "project ions" should read --projections--.

COLUMN 13:

Line 65, "iS" should read --is--.

COLUMN 17:

Line 17, "lengthwisely," should read --lengthwisely--.

Signed and Sealed this

Ninth Day of September, 1997

Bruce Lehman

*Attest:*

BRUCE LEHMAN

*Attesting Officer*

*Commissioner of Patents and Trademarks*